United States Patent [19]

Hardy et al.

[11] Patent Number: 4,875,870

[45] Date of Patent: Oct. 24, 1989

[54] ARTICLE FOR PROTECTING A SUBSTRATE

[75] Inventors: Judy Hardy, Swindon, England; Kenneth Wallington, Cirencester, United Kingdom

[73] Assignee: Raychem Limited, Swindon, England

[21] Appl. No.: 220,184

[22] Filed: Jul. 18, 1988

[30] Foreign Application Priority Data

Jul. 16, 1987 [GB] United Kingdom ..... 8716814
Sep. 23, 1987 [GB] United Kingdom ..... 8722434

[51] Int. Cl.[4] ..... H01R 4/60

[52] U.S. Cl. ..... 439/204; 439/426; 439/936; 174/76; 29/883

[58] Field of Search ..... 439/204, 519, 199, 521, 439/271, 936, 278, 279, 587, 589; 174/76; 29/855, 883, 885

[56] References Cited

U.S. PATENT DOCUMENTS

| | | | |
|---|---|---|---|
| 3,755,615 | 8/1973 | Paullus et al. | 174/76 |
| 3,772,637 | 11/1973 | Paullus et al. | 174/76 |
| 4,497,531 | 2/1985 | Baker | 439/271 |
| 4,662,692 | 5/1987 | Uken et al. | 439/426 |

FOREIGN PATENT DOCUMENTS

| | | |
|---|---|---|
| 1507027 | 4/1978 | United Kingdom . |
| 1570810 | 7/1980 | United Kingdom . |
| 2095050 | 9/1982 | United Kingdom . |

*Primary Examiner*—Neil Abrams
*Assistant Examiner*—Khiem Nguyen
*Attorney, Agent, or Firm*—Herbert G. Burkard; Bernard J. Lyons

[57] ABSTRACT

An article for protecting a multiconductor connector comprising a container containing a layer of gel. In one embodiment the container can be moved relative to the container to compress the gel to seal the connector. In another embodiment the gel layer contains a plurality of holes which tend to close when the gel is compressed.

17 Claims, 2 Drawing Sheets

ARTICLE FOR PROTECTING A SUBSTRATE

This invention relates to an article for protecting a substrate, in particular to an article which can be used to seal wires and/or contact pins entering a connector.

Known prior art methods of sealing wires and/or contact pins include the use of grommets or other similar compression seals, and the use of heat shrinkable sealing sleeves. Other prior art methods use articles containing greases. However, greases lack any type of three-dimensional structural network, and this results in the greases generally being viscious and flowing when subjected to temperature and humidity cycling, thereby providing a relatively unstable means for protecting the pins and/or wires. In addition, greases, once applied are difficult to remove making inspection and/or repair difficult. Epoxies and other adhesives have also been used, but they are also disadvantageous in that reentry is difficult.

U.S. Pat. No. 4,662,692 describes a method of using a layer of gel to seal contact pins. The gel is surrounded on its sides, but not on either face by a container for ease of handling and subsequent to being cured is disposed adjacent a terminal block usable for connecting the electrical contact pins with the block, and such that an opposite exposed face of the gel is not covered by the container which allows the electrical contact pins to be inserted there through so as to pierce through the gel and therefore be capable of making contact on the block side of the gel.

The present invention provides an improved article for sealing to a multiconductor connector in which the gel container is provided with special securement means to improve the compression on the gel and hence improve the seal.

In another embodiment the present invention provides a new form of article suitable for sealing to contact pins and/or wires, which uses a layer of gel through which holes for the pins and/or wires are preformed, so that the gel is not deleteriously damaged during insertion of the pins and/or wires, the holes sealing up against the wires trailing from the contact pins when the gel is subjected to compression.

An excellent seal is particularly important in applications where the seal is to be subjected to pressure, e.g. where a terminal block (which once connected is a sealed system) is used in applications subject to temperature fluctuations.

A first aspect of the invention provides an article for protecting a multiconductor connector having a plurality of contact holes therein for receiving a plurality of contact pins, the article comprising:

(a) an open container having a base and sides and;

(b) within the container a layer of gel, wherein at least one of the following is satisfied:

(i) the sides of the open container can be secured in use in first and second positions relative to the multiconductor connector, and the base of the open container, is adjacent to the gel layer and allows passage of said contact pins and trailing wires therethrough but substantially prevents egress of the gel from the container, wherein at least when the container is secured in the said second position relative to the connector the gel is compressed; and (ii) the layer of gel contains a plurality of holes which can be aligned in used with the holes in the multiconductor connector, the holes tending to close when the gel is compressed.

A second aspect of the invention provides an assembly comprising an article according to the first aspect of the invention in combination with the multiconductor connector, the connector and article being movable towards each other to compress the gel.

In the assembly, the connector and the article according to the first aspect of the invention may or may not be detachable. Where they are not detachable by the installer, the connector and the article according to the first aspect of invention may be integrally formed so that they are initially in the said first position relative to each other.

A third aspect of the invention provides a method of protecting a multiconductor connector having a plurality of contact holes therein for receiving a plurality of contact pins, the method comprising:

(a) positioning an article according to the first aspect of the invention adjacent to the connector so that the first securing means on the container engages the connector in the first position;

(b) inserting the contact pins, and wires trailing from the contact pins through the base and through the gel into the contact holes in the multiconuuctor connector, and (c) moving the container relative to the connector so that it is in the said second position relative thereto and the gel is thereby compressed against the said inserted trailing wires.

Movement of the container relative to the connector from the first to so second positions increases the compression on the gel so that in the second position the gel is more compressed than in the first position. Preferably in the second position the gel is compressed at least 40%, more preferably at least 50%, more preferably at least 70%, especially preferably at least 80%.

Preferably the layer of gel in the container is of uniform thickness and after compression decreases its thickness by at least 40%, preferably at least 50% more preferably at least 70%, especially preferably at least 80%.

The term "base" of the container is used to mean the face of the container away from the face of the gel which is urged towards the connector to be sealed.

The base may be integrally formed with sides of the container, or separate therefrom. Where it is separate from the sides it may be considered simply as a backing layer for the gel. The base and sides may comprise the same or different materials. The base is arranged to allow passage of contact pins and their trailing wires therethrough, but substantially prevent egress of the gel from the container. In one embodiment the base comprises a grid having square or rectangular apertures therein. Where the base is an apertured grid the lines defining the grid preferably correspond with lines defining the apertures of the face of the multiconductor connector. This means when the container is pressed against the connector in the second position, the backing plate grid and connector face press together defining individually rectangular or square cells in which the contact pins end wires pass. The compression on the pins and trailing wires is thereby concentrated.

Where the base is separately formed from the sides of the container its movement out of the container in the direction away from the layer of gel is preferably limited. This maintains the base and the gel in the same position in relation to the container. The limiting may conveniently be affected by an inwardly directed lip on the sides of the container, against which the base abuts.

Any suitable securement means may be provided to allow the container to be secured in said first and second positions relative to the connector. In one embodiment the container comprises first and second securement means, which engage a member on the connector. For example the first and second securement means may comprises first and second lips on the side of the container which engage a corresponding lip on the connector.

Preferably when the container is secured to the connector the container sides overlap the edges of the connector, and movement of the container relative to the connector from said first to second position increases the area of overlap of the two parts. This may be achieved for example with a container the cross-sectional inner periphery of which corresponds substantially to the cross-sectional outer periphery of the connector, and in which first and second securement lips extend along the sides of the container in a plane parallel to backing plate. The first securement lips are preferably further from the backing layer than the second securement lips.

In an alternative embodiment, the connector itself comprises first and second securement lips, and the container a single securement lip.

The securement lips on the container and/or connector may extend along all or only some sides of the container. In one preferred embodiment, for a rectangular container, the securement lips thereon extend along the long sides only of the container. This container is preferably used in combination with a connector in which the securement lip thereon extends around all sides of the connector. In another preferred embodiment the securement lips extend around all sides of the container.

Any suitable material may be used to form the container, depending on the manner in which the container is secured on the connector. When securement lips extend along all sides of the container, the container preferably comprises a deformable, extendable material, to allow the container to be deformed to engage the lips. An example of a suitable deformable material is high tear strength silicone rubber. Where securement lips extend along only some, e.g. only two sides of the container a more rigid material can be used, since the position of the lips allows the container to be flexed for installation. Examples of suitable materials in this case are glass-filled nylon or polypropylene.

The contact pins may simply be pushed through the base of the container, or the base may also contains a plurality of holes, in alignment with those in the gel layer.

Where there are holes in the gel and/or base these may be the same shape and size as each other or different. Also they may be the same shape of size as the contact pin cross-section, and/or of the wire trailing from the contact pin. The hole sizes in the container base and in the gel may be the same size or slightly smaller, (preferably less than 0.5 mm smaller) than the size of the contact pins inserted therein.

As used herein, the term gel means a liquid-extended polymer composition having a cone penetration value (measured by a modifed version of ASTM D217, as described below) within the range from 30 to 400 ($10^{-1}$ mm); an ultimate elongation (measured by ASTM D412 as described below) greater than 100%, with substantially elastic deformation to an elongation of at least 100%. The term gel is used to cover compositions that are sometimes known as gelloids. The gel may either contain three-dimensional cross-linked molecular formations (gels) or may merely behave as if it contained such molecular formations (gelloids).

Any suitable gel can be used. The gel may contain three dimensional cross-linked molecular formations, or may merely behave as if it contained such molecular formations. One example of a gel that can be used is is a silicone gel. Another suitable gel comprises a block copolymer having relatively hard blocks and relatively elastomeric blocks (e.g. hydrogenated rubber blocks) examples of such copolymers including styrene-diene block copolymers (linear or radial) for example styrene-butadiene or styrene-isoprene diblock or triblock copolymers, or styrene-ethylene-butylene-styrenes triblock copolymers, as described in copending U.S. patent application Ser. No. 304,431 filed July 17, 1987. Other examples of suitable gels include a urethane, a silicone, or a nonsilicone liquid rubber with low or no unsaturation which has been cross-linked.

The gel may be formed in any suitable way. As examples: the gel may be formed from a single liquid material which becomes a gel when subjected to radiation or chemicals; the gel may be formed from two-components which become a gel when mixed; or the gel may be a composition which is a gel at room temperature and can be remelted by heating, so that it is formable, and again cooled, without any significant change in its physical properties.

In a particularly preferred embodiment the gel is provided on a foam support member. Specifically the foam network is characterized by a flexible matrix having a plurality of open interstices having an average volume of less than 0.01 $ins^3$, the gel including a plurality of interconnected segments which lie within the interstices of the matrix, the matrix and the gel being such that when they are stretched, the matrix reaches its ultimate elongation before the gel reaches its ultimate elongation.

The ratio by volume of the encapsulant to the matrix is preferably at least 7.0, particularly at least 9.0, especially at least 9.5.

The matrix is preferably in the form of a sheet (this term being used to include tape), the sheet preferably having a thickness of 10 to 300 mils (0.025 to 0.76 cm), particularly 15 to 80 mils (0.04 to 0.20 cm), and the sheet preferably being extensible with an ultimate elongation which is preferably at least 50%, particularly at least 100%.

A particularly preferred support member for this embodiment of the invention is an open cell foam sheet of an organic coplymer, e.g. a polyurethane in particular an open cell foam having an average cell size of 5 to 30 mils (0.013 to 0.076 cm), preferably 10 to 20 mils (0.025 to 0.05 cm). Another useful support member is a woven or non-woven fabric comprising fibers which are natural or synthetic and composed of organic or inorganic material, e.g. glass fibers or organic polymer fibers. The foam sheet or fabric may be for example 5 to 60 mils (0.013 to 0.15 cm), particularly 10 to 50 mils (0.025 to 0.125 cm), thick.

The supported gel is particularly advantageous in the present invention since it has improved mechanical strength compared to a corresponding non-supported gel. The improved mechanical strength is advantageous since it minimizes damage to the gel during insertion of the contact pins. Also, where the backing layer is apertured it minimizes egress of the gel through the apertures in the base.

The preferred thickness of the gel depends inter alia on the type of gel used. For a gel on/in a support matrix a preferred thickness of gel is at least 2 mm, preferably at least 3 mm, more preferably about 4 mm.

The gels used in the present invention preferably have cone penetration values of 100 to 300. For some applications a cone penetration 220–280 is preferred.

The elongation of the gel is preferably at least 200%. Cone penetration and ultimate elongation values used in this specification are measured according to the following methods:

Cone Penetration

Test method ASTM D217, for testing cone penetration in greases, is applied to the gel or gelloid compositions of the present invention, using a standard full-scale cone, to determine the penetration at 23° C. by releasing the cone assembly from a penetrometer and allowing the cone to drop freely into the gel for 5 seconds.

The gel sample is contained in a straight-sided circular cylindrical container which is filled to the brim with the gel. The height of the beaker is 72 mm and its internal diameter is 74 mm. The surface of the sample should be level and free from defects where possible. Air bubbles, especially close to the surface of the sample, should be avoided, and the surface should be protected from dust prior to testing.

Each measurement should be made close to the center of the sample but not directly in the same place each time. Surface damage caused by the cone is generally clearly visible and must be avoided when making a subsequent measurement.

Tensile Testing

The method for the tensile testing of gels is a modified version of ASTM D412 in which tensile strength and ultimate elongation are measured at 23° C. on dumbell shaped gel specimens that have not been prestressed. Ultimate elongation is measured by 'jaw separation' and tensile strength is based on the original cross sectional area of a uniform section of the specimen.

Tensile tests are performed on a power driven machine equipped to produce a uniform rate of grip separation of 50 mm/min for a distance of at least 1000 mm. The equipment should be capable of measuring the applied force to within 2% and of recording the resultant stress strain curve on a chart recorder. In the current work tensile stress strain measurements of the gel samples were made using an Instron floor model, TT-BM, fitted with a load cell capable of measuring to a lower limit full-scale deflection of 0.4 Newton. The load was indicated on a variable speed chart recorder to an accuracy of 0.5%.

Samples for tensile testing are cut from sheets of gel of uniform thickness between 1 and 6 mm using a Type 1 BS 2782/ISO 37 or a Type 3ASTM D412 dumbell cutter.

The gel specimens once cut may be difficult to handle. This may be improved by wrapping the ends of each specimen in lint-free tissue up to the distance where the sample will protrude from the machine jaws, (see below). This has also been observed to have the additional beneficial effect of restricting the flow of gel from within the grips themselves when the sample is tested, thereby improving the accuracy of the elongation measurement.

The tensile machine should first be calibrated in the normal way. Conventional air-grips may be used at an operating air pressure of approximately 20 psi. The dumbell sample is placed in the jaws of the air-grips such that the jaws will hold predominately onto the tissue covering the ends of the specimen rather than the gel itself. Some exudation of the gel from the far ends of the grips may be observed on closing the jaws. This will not prove to be a problem provided that exudation into the restricted section of the sample, between the two grips is minimal. The tissue wrap will help to minimize this in the case of very soft gels.

The sample is then tested to failure, which should ideally occur in the restricted section, at a cross-head speed of 50 mm/min and the stress-strain curve recorded on a chart recorder. A chart speed of 20 mm/min was found to be adequate was found to be adequate for most samples.

The Ultimate Elongation of the sample may be obtained by calculating the cross-head movement from the chart recorder, (knowing the speeds of both). The elongation as a percentage of the original gauge length may then be determined.

The sample will preferably undergo elastic deformation and recovery as aforesaid, by which is meant that the stretched sample will "snap back" substantially to its original unstressed state if released from the elongation tension.

The invention is applicable for sealing any multicontact connectors, for example terminal blocks with at least 3, 6,12, or even 18 contact pin holes. The invention is particularly advantageous since it allows the sealing part (the article) to be placed against the connector before the contact pins are inserted. This is an important advantage for automated pin-insertion. In contrast, with other prior art methods, for example where sealing shrinkable sleeves, are used, these sleeves have to be fed over the contact pin wires before the contact pins are inserted in the connector.

The article is also advantageous where good sealing is required, both against external chemical environment and internal and external pressure.

A range of wire diameters can be sealed according to the invention. For example wires with outer diameters in the range of 2–2.6 mm or even 1–3.5 mm.

Embodiments of the present invention will now be described with reference to the accompanying drawings, wherein.

Figure 1:
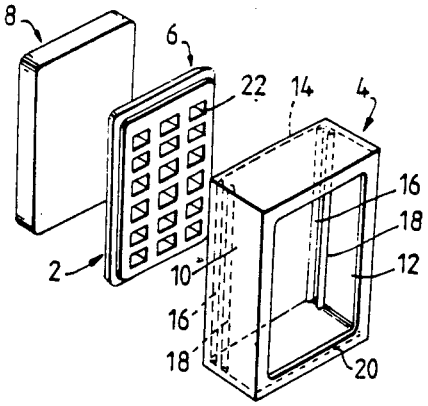
FIG. 1 is an exploded view of an article according to the invention.
Figure 2:
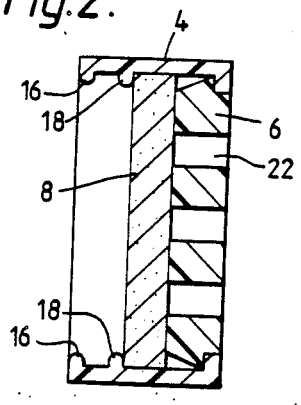
FIG. 2 is a sectional view of the article of FIG. 1.

Referring to the drawings, FIGS. 1 and 2 show an article 2 according to the invention comprising a rectangular container 4, base 6 and gel layer 8. The container 4 is made from polypropylene and has sides 10, and open faces 12 and 14, thereby defining an open ended rectangular structure. On the two long sides 10 of the rectangular container 4 are two rows of securement lips 16 and 18 are for securement to a connector, as will be explained later. The sides 10 of the container 4 also comprise a third lip 20 at end face 12. This lip extends around the entire periphery of the container. Against this lips 20 abuts base 6, thereby limiting movement of the base out of the container in a direction away from the gel (i.e. to the right in the Figure).

Base 6 comprises glass-filled nylon material. It is in the form of a grid with apertures 22 therein in a 6×3 array. The grid 6 fits inside container 4, but is stopped from passing therethrough by lip 20.

Finally gel layer 8 comprises a layer of GelTek strip as supplied by Raychem Limited. This strip is coterminous with base 6 and is positioned thereagainst.

Figure 3:
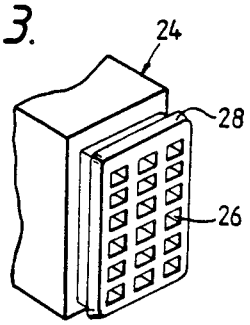
FIG. 3 is a perspective view of a multi contact connector to be sealed by the article of FIGS. 1 and 2 or the article of FIGS. 6 and 7.

FIG. 3 shows the connector 24 to be sealed. It also contains eighteen holes 26 in a 6×3 array. The connector comprises a lip 28 to cooperate with lips 16+18 on the article 2 of FIGS. 1 and 2.

Figure 4:
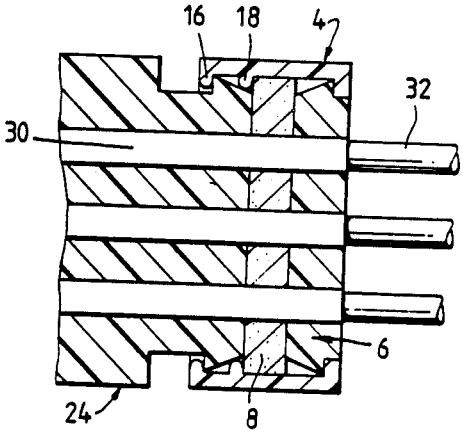
FIG. 4 is a sectional view of the article of FIGS. 1 and 2 positioned adjacent the connector of FIG. 3 with contact pins inserted through the article into the connector.

FIG. 4 shows the article 2 positioned adjacent connector 24. The positioning is such that the grid array of connector 24 is in alignment with the grid array of base 6. The connector and article are in a first positions in which lip 16 (nearest the connector 24) engages lip 28 on the connector 24. The gel is in this position not compressed. Contact pins 30 and trailing wires 32 are inserted through the holes 22 in the base 6 and into the holes 26 in the connector 24, to contact mating contact pins inserted from the other side.

Figure 5:
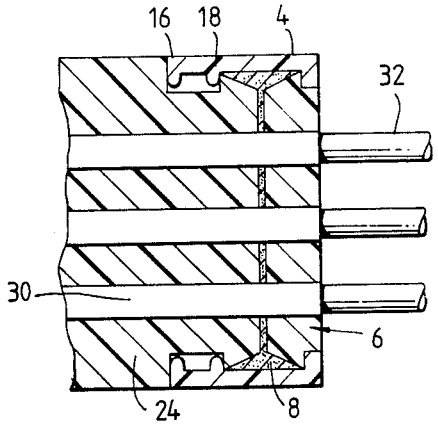
FIG. 5 is a cross-sectional view, corresponding to FIG. 4, but showing the article secured against the connector so as to compress the gel contained therein.

FIG. 5 corresponds to FIG. 4 except that the article 2 and the connector 24 have been pushed further towards each other into a second position in which the lip 18 on the container 4 engages the lip 28 on the connector 24. In this second position the area of overlap of the container 4 and connector 24 is increased relative to the first position. The gel layer 8 is compressed about 80%, and hence seals against the trailing wires 32.

Typical dimensions for the article and connector described in FIGS. 1 to 5 are as follows:

| | |
|---|---|
| Connector 24 | |
| Back face | 35 mm × 27 mm |
| Lateral extension of lip | 24 × 1.5 mm |
| Base 6 | |
| Face | 27 mm × 36 mm |
| Height | 5 mm |
| Gel Layer 8 | |
| Face | 27 mm × 36 mm |
| Thickness | 4 mm |
| Contact Pins | |
| End pin shape: typically rectangular | |
| Male 3.0 mm flat | |
| Female 2.7 mm × 4.1 mm box-shape | |
| Conductors circular cross-section | |
| Typically 0.5 $mm^2$–2.5 $mm^2$ | |
| Typical example 2.3 mm OD | |

Figure 6:
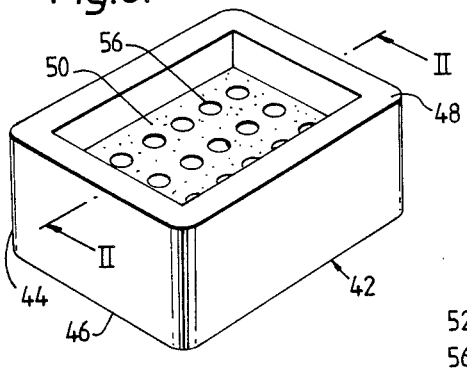
FIG. 6 is a perspective view of another article according to the invention.
Figure 7:
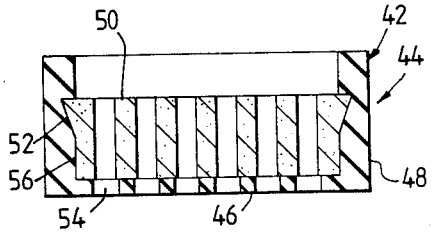
FIG. 7 is a cross-sectional view along line II—II of FIG. 6.

FIGS. 6 and 7 show another article 42 according to the invention. Article 42 comprises a container 44, with base 46 and sides 48. It has one open side. The container is made from silicone rubber. Inside the container is a layer of precured gel 50 which partly fills the container 44 and comprises a silicone gel.

The sides 48 of container 44 comprises a lip 52. This is for securement to the connector shown in FIG. 3. The gel layer 50, which is uniform in thickness, fills the container to the base of lip 52.

Eighteen holes arranged in a 6×3 array are premade through the base 46 of the container 44 and through the gel layer 50. The holes are numbered 54 and 56 respectively and are in alignment. The holes are circular in cross-section and are large in the base 46 of the container 44 than in the gel 50.

Figure 8:
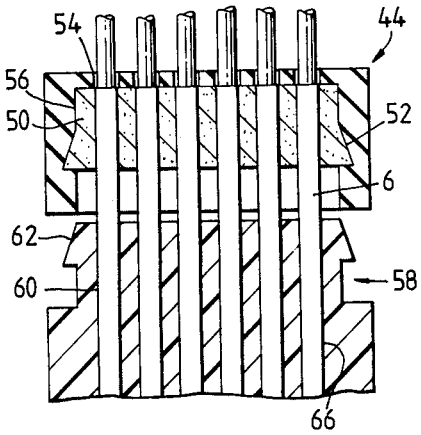
FIG. 8 is a cross-sectional view of the article of FIGS. 6 and 7 positioned adjacent the connector of FIG. 3 with contact pins inserted through the article into the connector.

FIG. 8 shows the article 42 positioned adjacent connector 24 of FIG. 3. The positioning is such that the holes 54 and 56 in the container 44 are in alignment with the holes 60 in the connector, but the gel 50 is not compressed, and lips 52 and 62 are not engaged. Contact pins 66 and trailing wires 67 are inserted through the holes 54 in the base by the container 44, through the holes 56 in the gel layer 50 into the holes 62 in the connector 58 to contact mating contact pins inserted from the other side.

Figure 9:
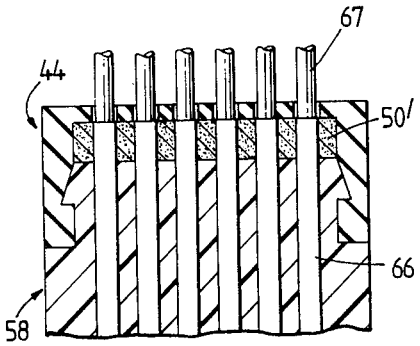
FIG. 9 is a cross-sectional view, corresponding to FIG. 8, but showing the article secured against the connect so as to compress the gel contained therein.

FIG. 9 corresponds to FIG. 8 except that the article 42 and the connector 58 have been pushed towards each other so that lips 52 and 62 co-operate. This compresses gel 50 about 80%, and hence seals against the trailing wires 67 from contact pins 66.

Typical dimensions for the article and connector described in FIGS. 6 to 9 are as follows:

| | |
|---|---|
| Connector 58 | |
| Back face | 35 mm × 27 mm |
| Lateral extension of lip | 24 × 1.4 mm |
| Article 42 | |
| Base 46 | 40 mm × 31 mm |
| Height | 17 mm |
| Thickness of base | 2 mm |
| Depth of gel | 10 mm |
| Height of lip 52 | 5 mm |
| Lateral extension of lip 52 | 1.5 mm |
| Contact Pins | |
| End pin shape: typically rectangular | |
| Male 3.0 mm flat | |
| Female 2.7 m × 4.1 mm box shape | |
| Conductors circular cross-section | |
| Typically 0.5 $mm^2$–2.5 $mm^2$ | |
| Typical example 2.3 mm OD | |

We claim:

1. An article for protecting a multiconductor connector having a plurality of contacts holes therein for receiving a plurality of contact pins, the article comprising:

(a) an open container having a base and sides and;

(b) within the container a continuous layer of gel having a cone penetration value within the range of from 30 to 400 ($10^{-1}$ mm), wherein:

the sides of the open container can be secured in use in first and second positions relative to the multiconductor connector and the base of the open container is adjacent to the gel layer and allows passage of said contact pins and trailing wires therethrough but substantially prevents egress of the gel from the container, wherein at least when the container is secured in the said second position relative to the container the gel is compressed.

2. An article according to claim 1, wherein when the container is secured in the said first position relative to the connector the gel is not compressed.

3. An article according to claim 1, wherein movement of the base out of the container in the direction away from the layer of gel is limited.

4. An article according to claim 3, wherein the container sides comprise an inwardly directed lip to limit the movement of the base.

5. An article according to claim 3, wherein the base is integrally formed with the sides of the container.

6. An article according to claim 1, wherein when the container is secured to the connector the container sides overlap the edges of the connector, and wherein movement of the container relative to the connector from said first to second position increases the area of overlap of the two parts.

7. An article according to claim 1, wherein the base comprises a plurality of apertures to allow the passage of the contact pins and trailing wires therethrough.

8. An article according to claim 7, wherein the apertures in the base correspond to the plurality of contact holes in the multiconductor connector.

9. An article according to claim 7, wherein the base comprises a rectangular apertured grid.

10. An article according to claim 1, wherein the container comprises first and second securing means in the form of first and second lips on the sides of the container, which can be secured to a corresponding lip of the connector.

11. An article according to claim 10, wherein at least the sides of the container comprise a deformable material, the deformability of the container allows the container to be deformed to interengage the lip(s) of the container and the multiconductor connector.

12. An article according to claim 1, wherein the gel is substantially uniform in thickness, and is at least 2 mm thick, preferably at least 3 mm thick.

13. An article according to claim 1, wherein the gel has a cone penetration of approximately 30–400 ($10^{-1}$ mm) and an ultimate elongation of at least 100%.

14. An article according to claim 1, wherein the gel is provided as an impregnant comprising a plurality of interconnected segments within a flexible matrix which comprises a plurality of open interstices, the interstices having an average volume of less than 0.01 $inch^3$ (0.16 $cm^3$).

15. An article according to claim 1, wherein the container is secured in the second position relative to the connector the gel is compressed at least 40%, preferably at least 50%, more preferably at least 80%.

16. An assembly comprising an article according to claim 1, in combination with the multiconductor connector, the connector and article being movable towards each other into said second position to compress the gel.

17. A method of protecting a multiconductor connector having a plurality of contact pins, the method comprising:

(a) positioning an article according to any preceding claim adjacent the connector so that the sides of the open container are secured in the first position relative to the multiconductor connector;

(b) inserting the contact pins and wires frailing from the contact pins through the base and through the gel into the contact holes in the multiconductor connector, and (c) moving the container relative to the connector so that it is in the second position relative thereto and the gel is thereby compressed against the said inserted trailing wires.

* * * * *